US007228799B2

(12) United States Patent
Maruyama et al.

(10) Patent No.: US 7,228,799 B2
(45) Date of Patent: Jun. 12, 2007

(54) MOVING MEMBER FIXING APPARATUS

(75) Inventors: Shigeru Maruyama, Ibaraki (JP); Takanobu Aoki, Ibaraki (JP)

(73) Assignee: Komori Corporation, Tokyo (JP)

( * ) Notice: Subject to any disclaimer, the term of this patent is extended or adjusted under 35 U.S.C. 154(b) by 211 days.

(21) Appl. No.: 10/938,176

(22) Filed: Sep. 10, 2004

(65) Prior Publication Data

US 2005/0061173 A1 Mar. 24, 2005

(30) Foreign Application Priority Data

Sep. 18, 2003 (JP) ..... 2003-326930

(51) Int. Cl.
*B41F 13/12* (2006.01)

(52) U.S. Cl. ..... 101/230; 101/248; 74/439; 74/440; 74/395

(58) Field of Classification Search ..... 101/223, 101/230, 248; 74/439, 440, 395, 444
See application file for complete search history.

(56) References Cited

U.S. PATENT DOCUMENTS 444,106 A * 1/1891 Spraker ..... 225/75
3,700,292 A 10/1972 Owens
4,133,085 A 1/1979 Hansson
4,457,231 A * 7/1984 Kawaguchi ..... 101/230
4,787,261 A * 11/1988 Becker ..... 74/439
4,805,475 A 2/1989 Hannel
5,410,959 A 5/1995 Sugiyama et al.
5,588,363 A * 12/1996 Becker ..... 101/230
5,802,920 A * 9/1998 Becker ..... 74/439

FOREIGN PATENT DOCUMENTS

FR 1148367 12/1957
GB 2309421 7/1997

* cited by examiner

*Primary Examiner*—Daniel J. Colilla
*Assistant Examiner*—Kevin D. Williams
(74) *Attorney, Agent, or Firm*—Blakely Sokoloff Taylor & Zafman

(57) ABSTRACT

A moving member fixing apparatus includes a stationary gear, rotary gear, press member, and first and second flat inclined surfaces. The rotary gear is movably provided to the stationary gear. The press member presses the rotary gear to fix the rotary gear to the stationary gear, and cancels pressing the rotary gear so that the rotary gear is released from the stationary gear. The first flat inclined surface is formed to be associated with the stationary gear. The second flat inclined surface is formed on the press member and comes into contact with the first inclined surface

19 Claims, 4 Drawing Sheets

MOVING MEMBER FIXING APPARATUS

BACKGROUND OF THE INVENTION

The present invention relates to a moving member fixing apparatus which has a stationary member and a moving member movable with respect to the stationary member and fixes the stationary member by pressing the moving member against the stationary member.

As the most typical example of a moving member fixing apparatus of this type, a printing switching apparatus for a sheet-fed offset rotary printing press with a convertible press mechanism is available which can perform both single-sided printing and double-sided printing with one printing press. The printing switching apparatus for a sheet-fed offset rotary printing press with a convertible press mechanism has a fixed gear fixed to the end shaft of a convertible cylinder, and a rotary gear fixed to and released from the fixed gear. When switching operation is to be made between single-sided printing and double-sided printing, the phases in the circumferential direction of cylinder groups upstream and downstream, respectively, of the convertible cylinder are adjusted.

As shown in U.S. Pat. No. 5,410,959, a conventional moving member fixing apparatus has a disk with a flange that fits in an annular groove formed in a rotary gear. The groove and flange portion have inclined surfaces that are to come into contact with each other. When the disk moves, the rotary gear is fixed to the fixed gear by the wedge operation of the inclined surfaces.

In the conventional moving member fixing apparatus, the groove is formed in the entire circumferential portion of the rotary gear, and the strength of the rotary gear decreases accordingly. The inclined surfaces of the groove and flange that are to come into contact with each other form curved surfaces in the circumferential direction of the rotary gear. It is difficult to obtain uniform working accuracy throughout the entire inclined surfaces. Thus, the moving member cannot be fixed to the stationary member reliably.

SUMMARY OF THE INVENTION

It is an object of the present invention to provide a moving member fixing apparatus which can fix a moving member to a stationary member reliably.

In order to achieve the above object, according to the present invention, there is provided a moving member fixing apparatus comprising a stationary member, a moving member movably provided to the stationary member, a press member which presses the moving member to fix the moving member to the stationary member, and cancels pressing the moving member so that the moving member is released from the stationary member, a first flat inclined surface formed to be associated with the stationary member, and a second flat inclined surface which is formed on the press member and comes into contact with the first inclined surface.

DESCRIPTION OF THE PREFERRED EMBODIMENTS

A printing switching apparatus for a sheet-fed offset rotary printing press with a convertible press mechanism according to the first embodiment of the present invention will be described with reference to FIGS. 1 to 4B.

Figure 2:
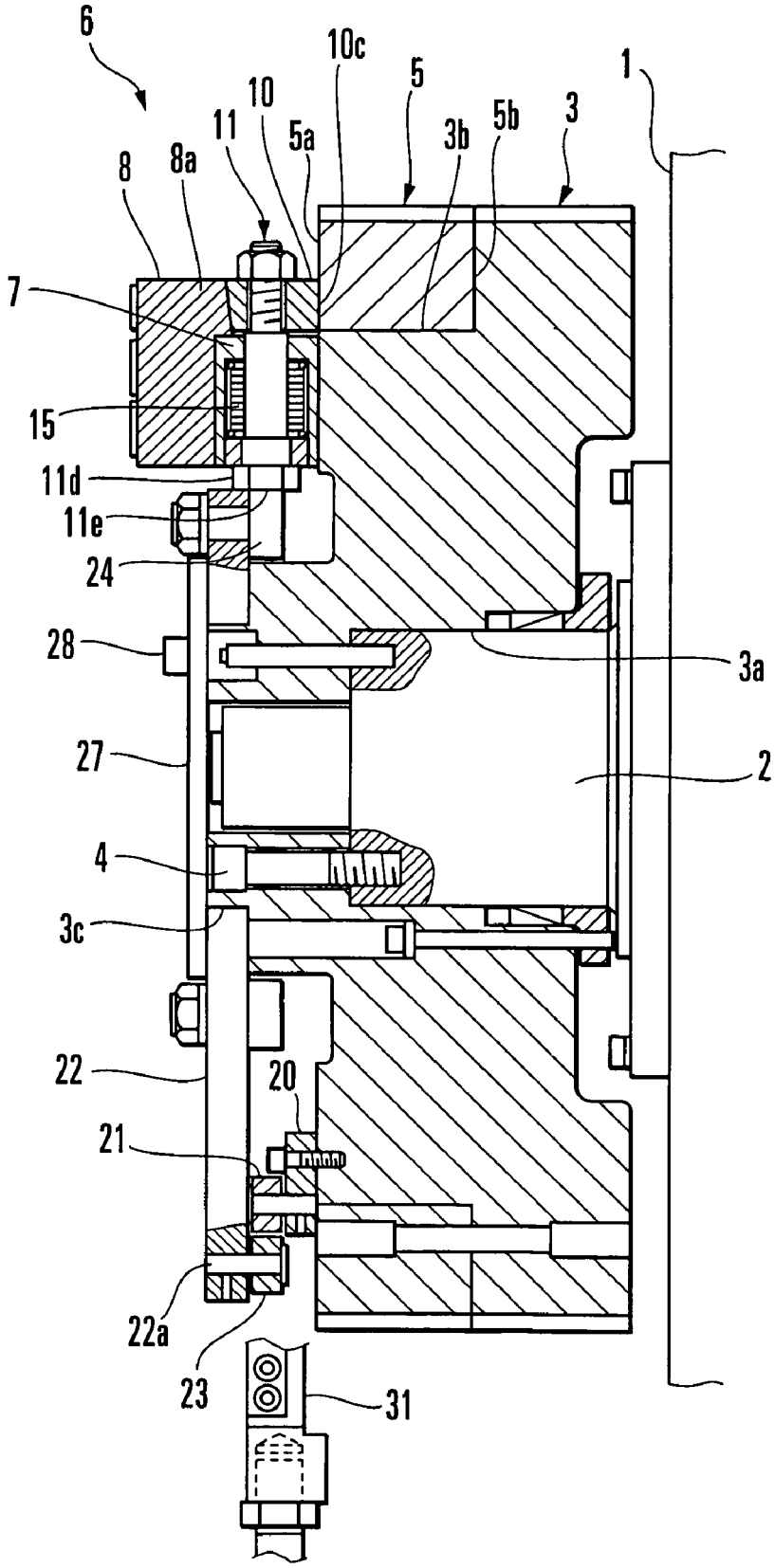
FIG. 2 is a side sectional view of the printing switching apparatus shown in FIG. 1.

As shown in FIG. 2, a stepped stationary gear 3 serving as a stationary member is fixed to an end shaft 2 of a convertible cylinder (not shown) rotatably, axially supported to a frame 1 of a printing press. The stationary gear 3 has a recessed hole 3*a* at its center. The stationary gear 3 is fixed to the end shaft 2 with a bolt 4 with the recessed hole 3*a* being fitted in the end shaft 2. A ring-like rotary gear 5 serving as a moving member is rotatably fitted on the outer surface of a small-diameter step 3*b* of the stationary gear 3. The stationary gear 3 meshes with the cylinder gear (not shown) of a cylinder downstream of the convertible cylinder. The rotary gear 5 meshes with the cylinder gear (not shown) of a cylinder upstream of the convertible cylinder.

Figure 1:
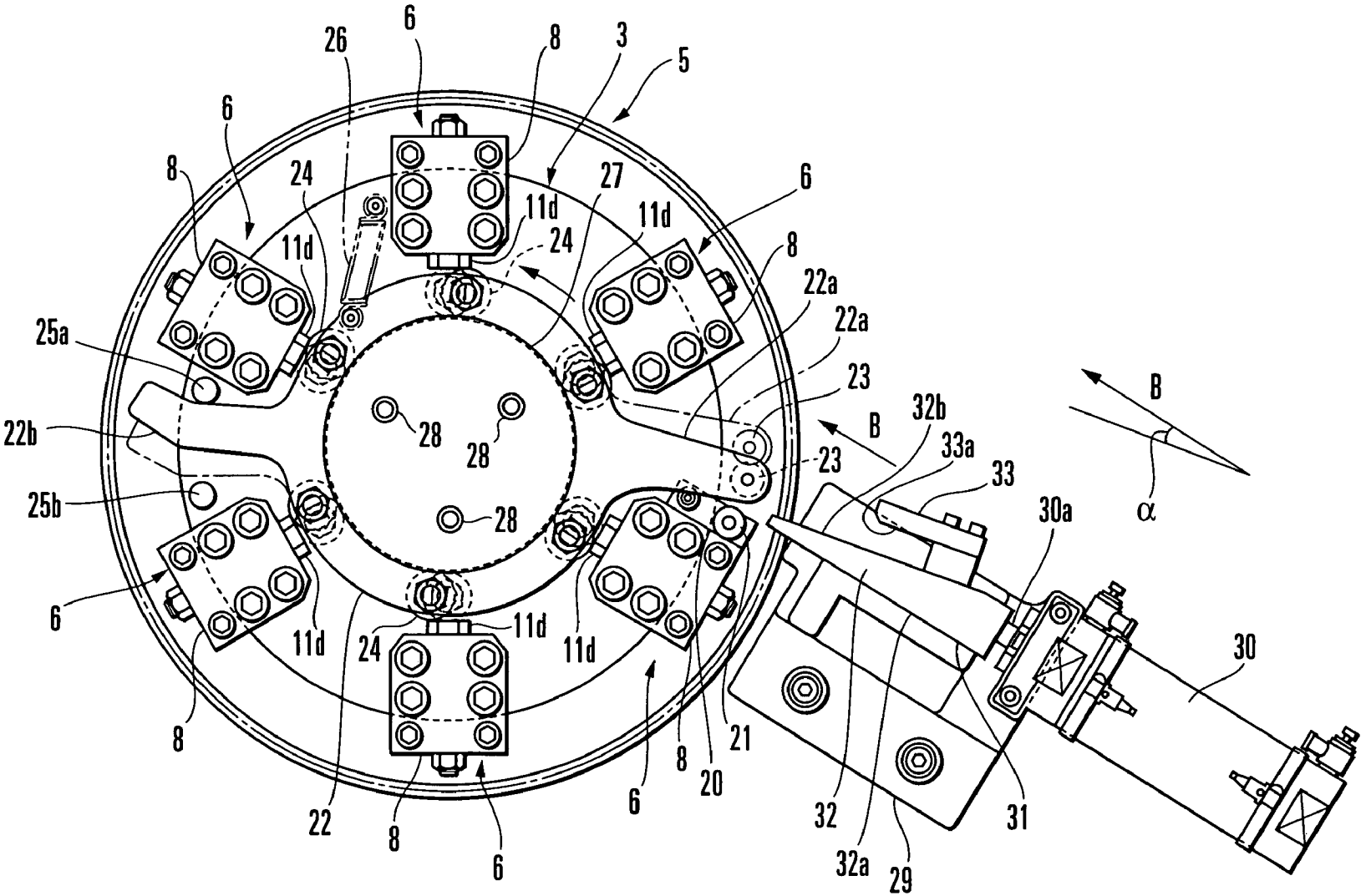
FIG. 1 is a front view of a printing switching apparatus in a sheet-fed offset rotary printing press with a convertible press mechanism according to the first embodiment of the present invention.
Figure 3A:
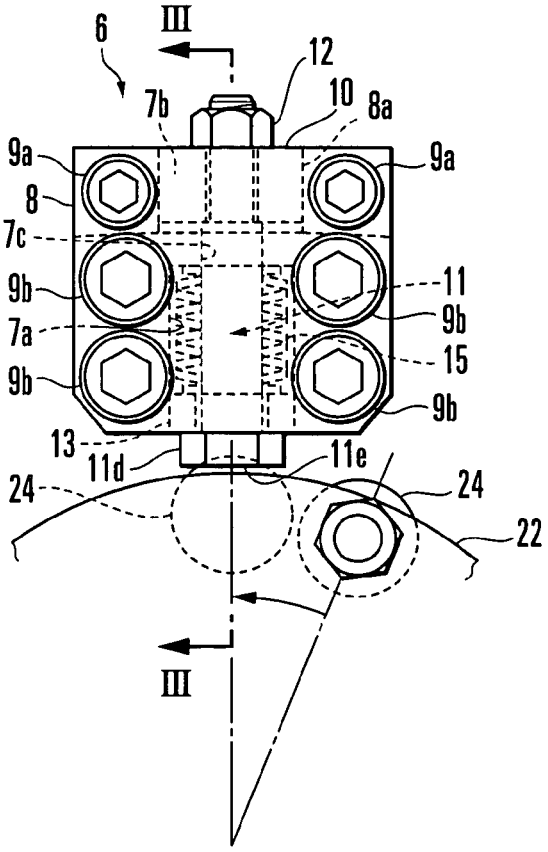
FIG. 3A is a front view of a main part showing a state wherein a rotary gear is fixed to a stationary gear.
Figure 3B:
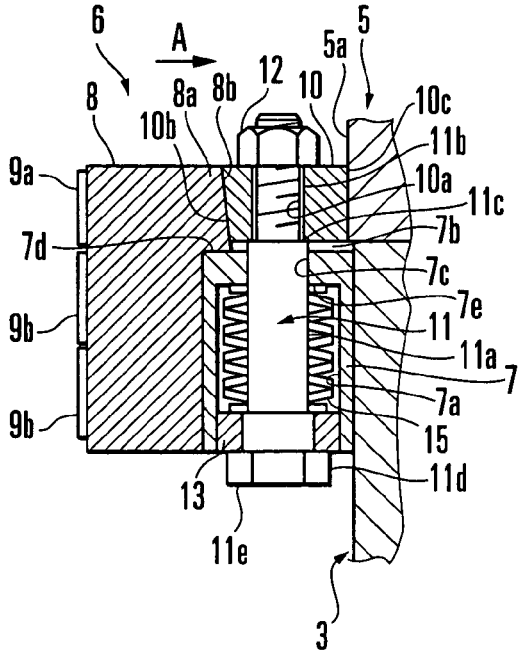
FIG. 3B is a sectional view taken along the line III-III of FIG. 3A.

As shown in FIG. 1, six fixing mechanisms 6 which fix the rotary gear 5 to the stationary gear 3 are arranged on the side surface of the rotary gear 5. The six fixing mechanisms 6 are arranged at equal angular intervals in the circumferential direction of the rotary gear 5. The six fixing mechanisms 6 have the same structure and accordingly will be typically described through one of them. As shown in FIGS. 3A and 3B, the fixing mechanism 6 has a flat, substantially rectangular parallelepiped support member 7 to be fixed to the stationary gear 3. The support member 7 has a hollow cylindrical recess 7*a* which opens downward, and a groove 7*b* formed at the upper central portion of the support member 7. A hole 7*c* through which the recess 7*a* and groove 7*b* communicate with each other is formed in the bottom of the recess 7*a*.

A flat, substantially square parallelepiped holding member 8 has a projection 8*a* at the center of its upper end on the rotary gear 5 side. A flat inclined surface 8*b* inclined in a direction (direction of an arrow A) to gradually come close to the rotary gear 5 from above downward is formed on the end face of the projection 8*a*. The support member 7 is attached to the holding member 8 with bolts 9*a* such that a bottom 7*d* of the groove 7*b* engages with the lower end of the projection 8*a* of the holding member 8. The support member 7 attached to the holding member 8 is clamped between the holding member 8 and the side surface of the stationary gear 3. In this state, bolts 9*b* inserted in the insertion holes (not shown) of the holding member 8 are threadably engaged in the tapped holes (not shown) of the stationary gear 3, respectively, so that the support member 7 is fixed to the side surface of the stationary gear 3. In other words, the support member 7 and holding member 8 are integrally fixed to the stationary gear 3.

A press member 10 formed to have a substantially rectangular parallelepiped shape has a tapped hole 10*a* at its center. A flat inclined surface 10*b* inclined in a direction (direction of the arrow A) to gradually come close to the rotary gear 5 from above downward is formed in the end face of the press member 10 which is in contact with the end face of the projection 8*a*. The press member 10 is fitted and inserted in the groove 7*b* of the support member 7 such that its inclined surface 10*b* is in contact with the inclined surface 8*b* of the projection 8*a* and that its end face 10*c* on the opposite side to the inclined surface 10*b* is in contact with one side surface 5*a* of the rotary gear 5.

A bolt 11 as a rod-like member has a columnar main body 11*a* and a threaded portion 11*b* formed at the distal end of the main body 11*a*. The main body 11*a* has a diameter larger than that of the threaded portion 11*b*. A step 11*c* is formed between the main body 11*a* and threaded portion 11*b*. The main body 11*a* has a diameter slightly smaller than that of the hole 7*c* of the support member 7. The distal end of the main body 11*a* of the bolt 11 extends through a hole 7*c* of the support member 7, and the threaded portion 11*b* threadably engages with the tapped hole 10*a* of the press member 10. In this state, a nut 12 is threadably engaged with the threaded portion 11*b*, so that the press member 10 is clamped by the step 11*c* of the bolt 11 and the nut 12. A ring-like member 13 is fitted on the bolt 11. The ring-like member 13 abuts against a head portion 11*d* of the bolt 11, so the ring-like member 13 is regulated from being removed from the bolt 11. The end face of the head portion 11*d* of the bolt 11 forms a first abutting portion 11*e*.

A Coned disc spring 15 serving as the first biasing member is elastically mounted between the ring-like member 13 and a bottom surface 7*e* of the recess 7*a* of the support member 7. The press member 10 is biased toward the support member 7 through the bolt 11 by the spring force of the Coned disc spring 15. At this time, the press member 10 is pressed in the direction (direction of the arrow A) to come close to the rotary gear 5 by the wedge operation of the inclined surface 10*b* of the press member 10 and the inclined surface 8*b* of the projection 8*a* fixed to the stationary gear 3. The end face 10*c* of the press member 10 presses one side surface 5*a* of the rotary gear 5 in the direction of the arrow A. The other end face 5*b* of the rotary gear 5 is urged against the end face of the stationary gear 3 in FIG. 3B. Hence, the rotary gear 5 is fixed to the stationary gear 3.

According to this arrangement, the inclined surface 8*b* of the projection 8*a* and the inclined surface 10*b* of the press member 10 which is in contact with the inclined surface 8*b* are formed flat. It suffices as far as the respective inclined surfaces are formed on the end portions of the corresponding members, and accordingly they can be formed with the same machining method. Therefore, the respective inclined surfaces can be machined with high accuracy. Consequently, the press member 10 can fix the rotary gear 5 to the stationary gear 3 reliably and smoothly. The rotary gear 5 and stationary gear 3 have no grooves. Thus, the strengths of the rotary gear 5 and stationary gear 3 do not degrade, and their durabilities improve.

A fixing/releasing structure for the rotary gear 5 with respect to the stationary gear 3 will be described.

As shown in FIGS. 1 and 2, a support piece 20 is fixed to the outer peripheral portion of the stationary gear 3, and a wheel 21 of the stationary member side is rotatably, axially supported by the support piece 20. A small-diameter portion 3*c* is integrally formed at the center of the side surface of the stationary gear 3, as shown in FIG. 2, and a ring-like pivotal member 22 is pivotally supported by the small-diameter portion 3*c*. First and second arms 22*a* and 22*b* formed at portions of the outer peripheral portion of the pivotal member 22 to be displaced from each other by 180° in the circumferential direction project in directions to separate from each other.

A wheel 23 of the pivotal member 22 side is rotatably, axially supported at the distal end of the first arm 22*a* such that it opposes the wheel 21. Six cam followers 24 serving as the second abutting portion are supported at those portions of the pivotal member 22 which equally divide the pivotal member 22 by six in the circumferential direction. The six cam followers 24 as the press mechanism are set at those positions where they can abut against the first abutting portions 11*e* of the bolts 11 of the six fixing mechanisms 6, respectively. In FIG. 1, stoppers 25*a* and 25*b* stand vertically from the end of the stationary gear 3. The second arm 22*b* of the pivotal member 22 engages with the stoppers 25*a* and 25*b*, to regulate the pivot range of the pivotal member 22.

More specifically, when the pivotal member 22 pivots counterclockwise and the cam followers 24 respectively abut against the first abutting portions 11*e* of the bolts 11, the second arm 22*b* is positioned spaced from the stopper 25*b*, as indicated by an alternate long and two short dashed line in FIG. 1. When the pivotal member 22 pivots counterclockwise excessively without stopping at a predetermined position, the stopper 25*b* regulates the pivot motion of the pivotal member 22. When the cam followers 24 abut against the first abutting portions 11*e* of the bolts 11, since the stopper 25*b* does not stop the pivot motion of the pivotal member 22, the cam followers 24 can be prevented from failing to abut against the first abutting portions 11*e* of the bolts 11 due to an assembly error or manufacture error.

The pivotal member 22 is biased clockwise in FIG. 1 by a tensile coil spring 26 hooked between the pivotal member 22 and stationary gear 3 and serving as the second biasing member. When the second arm 22*b* engages with the stopper 25*a*, the clockwise pivot motion of the pivotal member 22 is regulated, and the wheel 23 (rotary member side) opposes the wheel 21 (stationary member side). A disk-like removal preventive member 27 is fixed to the end of the stationary gear 3 with bolts 28 so as to cover the pivotal member 22 from the outside, as shown in FIG. 2, and regulates removal of the pivotal member 22 from the small-diameter portion 3*c*.

As shown in FIG. 1, an actuator 30 formed of a hydropneumatic cylinder is attached to a bracket 29 fixed to the frame 1, such that a rod 30*a* of the actuator 30 moves forward/backward in a direction of an arrow B, i.e., in the radial direction of a convertible cylinder (not shown), to be parallel to the frame 1. A working element 31 as an actuating portion is attached to the rod 30*a*. The working element 31 is formed of first and second working portions 32 and 33 opposing each other through a predetermined gap. When the rod 30*a* moves forward, the first working portion 32 is located at a position to enter between the wheels 21 and 23. The first working portion 32 has a reference surface 32*a* to come into contact with the wheel 21, and a first inclined surface 32*b* to come into contact with the wheel 23.

The second working portion 33 includes a second inclined surface 33*a* which abuts against the outer surface of the wheel 23 on the opposite side to the wheel 21 when the rod 30*a* moves backward. The second working portion 33 has a distal end shorter than that of the first working portion 32. The reference surface 32*a* of the first working portion 32 extends in the same direction as the forward direction B of the rod 30*a*. The distal end side of the first inclined surface 32*b* extends in a direction inclined counterclockwise from the arrow B by an angle α. The second inclined surface 33*a* of the second working portion 33 is formed parallel to the first inclined surface 32*b*. The gap between the second and first inclined surfaces 33*a* and 32*b* is set slightly larger than the diameter of the wheel 23 of the rotary member side.

In this arrangement, when the rod 30*a* of the actuator 30 moves forward, the working element 31 moves in the direction of the arrow B, and the first working portion 32 enters between the wheels 21 and 23. At this time, as the reference surface 32*a* of the first working portion 32 extends in the same direction as the moving direction of the working element 31, the first inclined surface 32*b* moves on the wheel 21. As the first inclined surface 32*b* is inclined from the arrow B by the angle α, when the working element 31 moves in the direction of the arrow B, the wheel 23 in contact with the first inclined surface 32*b* moves in a direction to separate from the wheel 21.

Figure 4A:
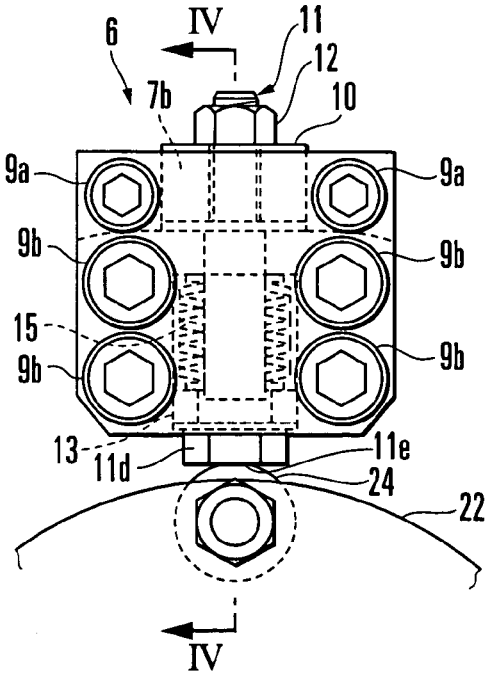
FIG. 4A is a front view of a main part showing a state wherein the rotary gear is disengaged from the stationary gear and can thus rotate.
Figure 4B:
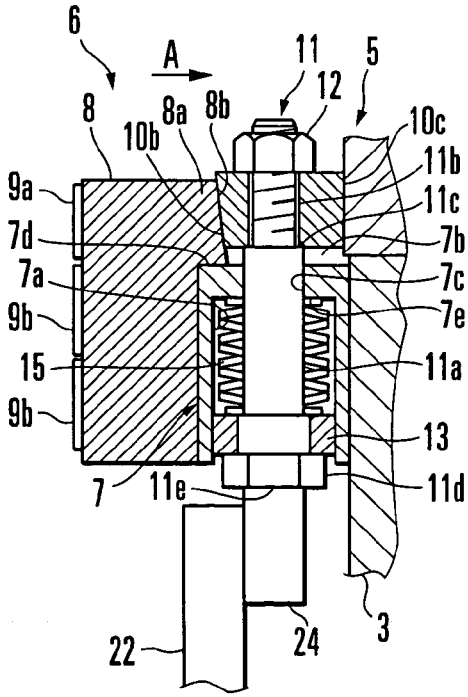
FIG. 4B is a sectional view taken along the line IV-IV of FIG. 4A.

Hence, the pivotal member 22 pivots counterclockwise, and each cam follower 24 abuts against the corresponding first abutting portion 11*e* of the bolt 11, as shown in FIGS. 4A and 4B, so that the bolt 11 moves in the direction of its distal end against the spring force of the Coned disc spring 15. Along with this, the press member 10 also moves in the direction to separate from the support member 7, and the wedge operation of the inclined surfaces 8*b* and 10*b* is canceled. The pressing operation of the press member 10 in the direction (direction of the arrow A) to come close to the stationary gear 3 is canceled, and the rotary gear 5 fixed to the stationary gear 3 is released from the stationary gear 3.

In this state, the phases in the circumferential direction of the cylinder groups upstream and downstream, respectively, of the convertible cylinder are adjusted. At this time, while the reference surface 32*a* of the first working portion 32 engages with the wheel 21, the wheel 23 engages with the first inclined surface 32*b*, so that the pivot motion of the stationary gear 3 is regulated. The rotary gear 5 can thus be rotated while the pivot motion of the stationary gear 3 is regulated. Hence, the phase adjusting operation for the cylinder groups upstream and downstream, respectively, of the convertible cylinder can be performed easily and reliably.

After the phase adjusting operation is ended, when the rod 30*a* of the actuator 30 moves backward, the second working portion 33 also moves backward, and the wheel 23 in contact with the second inclined surface 33*a* moves in a direction to come close to the wheel 21. Therefore, the pivotal member 22 pivots clockwise slightly, and abutment of the cam followers 24 and the first abutting portions 11*e* of the bolts 11 is canceled, as shown in FIG. 3A. This makes the pivotal member 22 pivotal, and the pivotal member 22 is pivoted clockwise by the tensile coil spring 26. As the pivotal member 22 pivots, the second arm 22*b* engages with the stopper 25*a*, and each bolt 11 is moved in the direction of its head portion by the spring force of the Coned disc spring 15. Accordingly, the press member 10 also moves downward. The press member 10 is pressed in a direction (direction of the arrow A) to come close to the rotary gear 5 by the wedge operation of the inclined surfaces 8*b* and 10*b*. Hence, the rotary gear 5 is fixed to the stationary gear 3.

According to this embodiment, the direction of the spring force of the Coned disc spring 15 is set in a direction perpendicular to a direction in which the rotary gear 5 is pressed against the stationary gear 3, that is, set in the radial direction of the convertible cylinder. The pivotal member 22 is pivoted by the rod 30*a* of the actuator 30 which moves forward/backward in the radial direction of the convertible cylinder, to fix and release the rotary gear 5 to and from the stationary gear 3. As a mechanism employing the leverage is not used, unlike in the prior art, the apparatus can be downsized.

The extending direction of the bolt 11 and the direction of the spring force of the Coned disc spring 15 are set in the radial direction of the convertible cylinder. Also, the press member 10 is pressed in the axial direction of the convertible cylinder by the wedge operation of the inclined surfaces 8*b* and 10*b*. Thus, the rotary gear 5 can be fixed to and released from the stationary gear 3 with the pressing force of the press member 10 which is obtained by amplifying the spring force of the Coned disc spring 15. Therefore, the spring force of the Coned disc spring 15, and the driving force of the actuator 30 itself which moves the bolt 11 against the spring force of the Coned disc spring 15 can be decreased. As a result, an actuator 30 having a small outer size can be used, and the space where the actuator 30 is to be installed can be decreased.

Figure 5A:
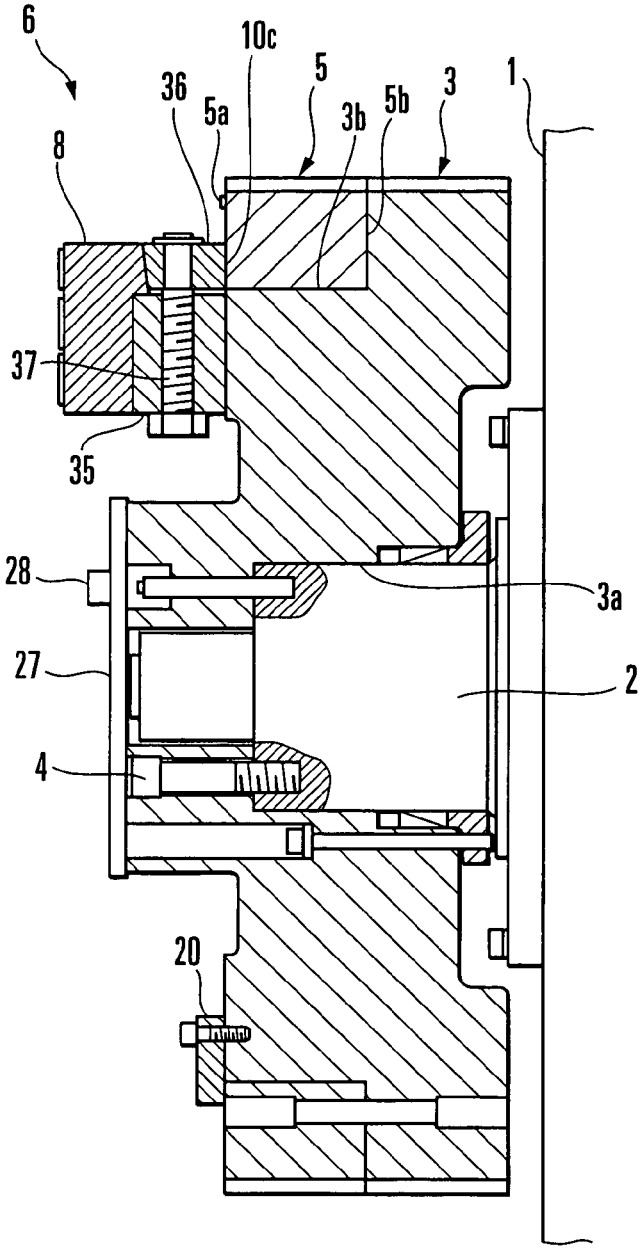
FIG. 5A is a side sectional view of a printing switching apparatus for a sheet-fed offset rotary printing press with a convertible press mechanism according to the second embodiment of the present invention.

A printing switching apparatus for a sheet-fed offset rotary printing press with a convertible press mechanism according to the second embodiment of the present invention will be described with reference to FIGS. 5A and 5B.

In the first embodiment described above, the rotary gear 5 is fixed to and released from the stationary gear 3 automatically with the actuator 30. The second embodiment is different from the first embodiment in that a rotary gear 5 is fixed to and released from a stationary gear 3 manually. In the second embodiment, a press member 36 is moved vertically by pivoting a flange 37*c* of a bolt 37 with a tool such as a wrench. Accordingly, the second embodiment does not include an actuator 30, a pivotal member 22 pivoted by the actuator 30, a Coned disc spring 15 which pushes a press member 10 downward, and the like.

Figure 5B:
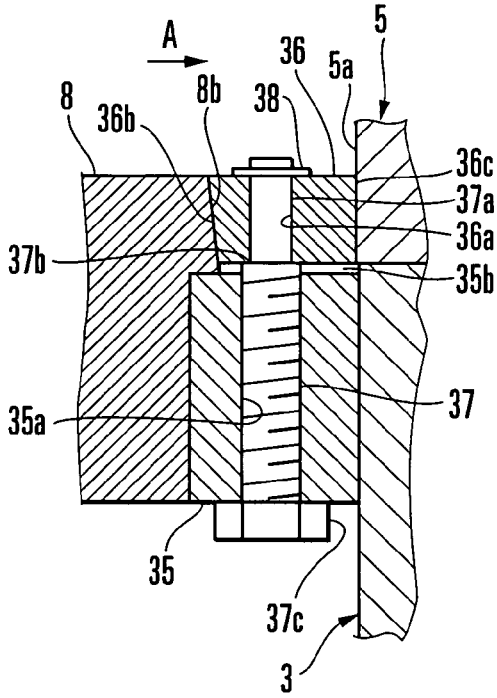
FIG. 5B is an enlarged sectional view of the main part of FIG. 5A.

Referring to FIG. 5B, a support member 35 is integrally fixed to the stationary gear 3 in the same manner as in the first embodiment described above, and has a tapped hole 35*a* formed in the radial direction of the convertible cylinder, and a groove 35*b* formed in the upper central portion of the support member 35. The press member 36 has a through hole 36*a* formed in the radial direction of the convertible cylinder, and an inclined surface 36*b* which is formed on one end face of the press member 36 and comes into contact with an inclined surface 8*b* of a holding member 8. The press member 36 is fitted and inserted in the groove 35*b* of the support member 35 such that an end face 36*c* of the press member 36 on a side opposite to the inclined surface 36*b* comes into contact with one side surface 5*a* of the rotary gear 5.

The bolt 37 serving as a rod-like member threadably meshes with the tapped hole 35*a* of the support member 35, and has a small-diameter portion 37*a*, at the distal end, which is exposed from the support member 35. A step 37*b* is formed between the small-diameter portion 37*a* and a threaded portion. The small-diameter portion 37*a* of the bolt 37 is inserted in the through hole 36*a* of the press member 36. The press member 36 is clamped by a ring 38 fitted in an annular groove (not shown) at the distal end of the bolt 37, and the step 37*b*.

In this arrangement, the head portion 37*c* of the bolt 37 is pivoted with a tool such as a wrench, to move the bolt 37 vertically. Then, the press member 36 moves vertically together with the bolt 37. As the press member 36 moves vertically, the rotary gear 5 is fixed to and released from the stationary gear 3. In this case, the wedge operation of the inclined surfaces 8*b* and 36*b* generates a force in the axial direction (directions to come close to and separate from the rotary gear 5) of the convertible cylinder, to fix and release the rotary gear 5. At this time, because a small force is amplified to a large force, no burden is applied to the operator.

In the embodiments described above, the stationary member and rotary member take the form of gears. Alternatively, the stationary member and rotary member may be a cam unit formed of a stationary cam and moving cam. In this case, a frame can be used in place of the stationary cam. Although a printing switching apparatus for a printing press has been described, the present invention can also be applied to a switching apparatus for a coating apparatus.

As has been described above, according to the present invention, two flat inclined surfaces that are to come into contact with each other can be machined at high accuracy. Therefore, a moving member can be fixed to a stationary member reliably and smoothly by using a press member. As the strengths of the moving member and stationary member are not decreased by formation of grooves, the durabilities of the moving member and stationary member are improved.

What is claimed is:

1. A moving member fixing apparatus comprising:

a stationary member:

a moving member movably provided to said stationary member;

a press member which presses said moving member to fix said moving member to said stationary member, and cancels pressing said moving member so that said moving member is released from said stationary member;

a first flat inclined surface formed on an intermediate member which is integrally fixed to said stationary member; and a second flat inclined surface which is formed on said press member and comes into contact with said first inclined surface, wherein said stationary member is fixed to a rotary shaft, said press member is supported regarding said stationary member to be movable in a radial direction of said rotary shaft, and when said press member moves in the radial direction of said rotary shaft, said press member moves in directions to come close to and separate from said movable member through said first and second inclined surfaces, wherein said press member is held between said first inclined surface and said moving member, biasing means for biasing said press member in the radial direction of said rotary shaft, wherein said press member presses said moving member through said first and second inclined surfaces when said press member is biased by said biasing means.

2. An apparatus according to claim 1, wherein said first and second inclined surfaces are inclined in a direction along which said press member comes close to said moving member when said moving member is being fixed to said stationary member.

3. An apparatus according to claim 1 further comprising:

a bolt to which said press member is fixed; and a support member which supports said bolt through a tapped hole to be movable in the radial direction of said rotary shaft, wherein when said bolt is rotated manually, said press member moves in the radial direction of said rotary shaft.

4. An apparatus according to claim 1 wherein said rotary shaft comprises an end shaft of a convertible cylinder of a sheet-fed offset rotary printing press with a convertible press mechanism, said stationary member comprises a stationary gear which is fixed to said end shaft of said convertible cylinder and has a step, said rotary member comprises a ring-like rotary gear rotatably fitted on a step of said stationary gear, and said press member presses a side surface of said rotary gear and fixes said rotary gear to the step of said stationary gear to be integral with the step.

5. An apparatus according to claim 1, wherein said intermediate member is a block member.

6. An apparatus according to claim 1 wherein said biasing means includes a rod-like member which has a first abutting portion and to which said press member is fixed, a support member which supports said rod-like member to be movable in the radial direction of said rotary shaft, and a first biasing member which biases said rod-like member supported by said support member toward a center of said rotary shaft.

7. An apparatus according to claim 6, further comprising a pivotal member which is pivotally supported by said rotary shaft and has a second abutting portion to abut against said first abutting portion, wherein when an abutting state of said first and second abutting portions is canceled, said rod-like member is moved by a biasing force of said biasing member toward the center of said rotary shaft, so that said moving member is fixed to said stationary member, and when said first and second abutting portions are in the abutting state, said rod-like member moves apart from the center of said rotary shaft against the biasing force of said biasing member, so that said moving member is released from said stationary member.

8. An apparatus according to claim 7, further comprising:

a plurality of press mechanisms which are provided to said rotary member at equal angular intervals to be substantially concentric and each of which has said second abutting portion, and a plurality of fixing mechanisms which are arranged to correspond to said plurality of press mechanisms and each of which has said press member, said first and second inclined surfaces, and said first abutting portion, wherein when said actuator performs first operation, said pivotal member pivots, and said second abutting portion engages with said first abutting portion to release said moving member from said stationary member, and when said actuator performs second operation in a direction opposite to the first operation, said pivotal member pivots in an opposite direction, and said second abutting portion separates from said first abutting portion to fix said moving member to said stationary member.

9. An apparatus according to claim 7, further comprising an actuator which pivots said pivotal member.

10. An apparatus according to claim 9, further comprising an engaging member supported by said pivotal member, an operating member of said actuator, said operating member having an inclined surface to abut against said engaging member, and a biasing member which biases said pivotal member in a direction in which said engaging member comes close to said inclined surface of said operating member, wherein when said inclined surface of said operating member engages with said engaging member by operation of said actuator, said pivotal member is pivoted against the biasing force of said biasing member.

11. An apparatus according to claim 9, wherein said actuator comprises a hydropneumatic cylinder having a rod that can move forward/backward.

12. An apparatus according to claim 9, further comprising:

a first engaging member provided to said stationary member;

a second engaging member supported by said pivotal member;

a second biasing member which biases said pivotal member so that said second engaging member comes close to and opposes said first engaging member; and a first operating member of said actuator which enters between said first and second engaging members and pivots said pivotal member.

13. An apparatus according to claim 12, further comprising a stopper which is fixed to said stationary member and regulates pivot motion of said pivotal member so that said second engaging member is stopped at a predetermined gap from said first engaging member.

14. An apparatus according to claim 12, wherein said first operating member has a reference surface which comes into contact with said first engaging member, and an inclined surface which comes into contact with said second engaging member.

15. An apparatus according to claim 12, wherein said actuator has a rod which moves forward/backward, when said rod of said actuator operates in a first direction, said pivotal member pivots in a first pivot direction, so that said second abutting portion abuts against said first abutting portion, and when said rod of said actuator operates in a second direction opposite to the first direction, said pivotal member pivots in a second pivot direction opposite to the first pivot direction, so that abutment of said second abutting portion against said first abutting portion is canceled.

16. An apparatus according to claim 15, further comprising a second operating member supported by said first operating member, wherein said second operating member engages with said second engaging member when said rod of said actuator operates in the second direction.

17. An apparatus according to claim 16, wherein said second operating member has an inclined surface which opposes an inclined surface of said first operating member and is parallel thereto, when said rod of said actuator moves in the first direction, said first operating member enters between said first and second engaging members, said second engaging member moves in a direction to separate from said first engaging member while being in contact with said first operating member, and accordingly said pivotal member pivots in a direction opposite to a biasing direction of said biasing member, so that said second abutting portion abuts against said first abutting portion, during moving operation of said moving member with respect to said stationary member, a state wherein said second engaging member engages with the inclined surface of said first operating member is maintained with a reference surface of said first operating member engaging with said first engaging member, and when said rod of said actuator moves in the second direction, said second engaging member moves in a direction to come close to said first engaging member while being in contact with an inclined surface of said second operating member, and said pivotal member pivots in a biasing direction of said biasing member, so that abutment of said second abutting portion against said first abutting portion is canceled accordingly.

18. A moving member fixing apparatus comprising a stationary member, said stationary member is fixed to a rotary shaft;

a moving member movably provided to said stationary member;

a press member which presses said moving member to fix said moving member to said stationary member, and cancels pressing said moving member so that said moving member is released from said stationary member;

a first flat inclined surface formed to be associated with said stationary member through an intermediated member;

a second flat inclined surface which is formed on said press member and comes into contact with said first inclined surface, wherein said press member is supported regarding said stationary member to be movable in a radial direction of said rotary shaft, when said press member moves in the radial direction of said rotary shaft, said press member moves in directions to come close to and separate from said movable member through said first and second inclined surfaces, said press member is held between said first inclined surface and said moving member; and biasing means for biasing said press member in the radial direction of said rotary shaft, wherein said press member presses said moving member through said first and second inclined surfaces when said press member is biased by said biasing means.

19. A moving member fixing apparatus comprising a stationary member, said stationary member is fixed to a rotary shaft;

a moving member movably provided to said stationary member;

a press member which presses said moving member to fix said moving member to said stationary member, and cancels pressing said moving member so that said moving member is released from said stationary member;

a first flat inclined surface formed to be associated with said stationary member through an intermediated member;

a second flat inclined surface which is formed on said press member and comes into contact with said first inclined surface, wherein said press member is supported regarding said stationary member to be movable in a radial direction of said rotary shaft, when said press member moves in the radial direction of said rotary shaft, said press member moves in directions to come close to and separate from said movable member through said first and second inclined surfaces, said press member is held between said first inclined surface and said moving member;

a bolt to which said press member is fixed; and a support member which supports said bolt through a tapped hole to be movable in the radial direction of said rotary shaft, wherein when said bolt is rotated manually, said press member moves in the radial direction of said rotary shaft.

* * * * *